United States Patent [19]

Brody et al.

[11] 4,086,781

[45] May 2, 1978

[54] VARIABLE AIR VOLUME AIR CONDITIONING SYSTEM

[75] Inventors: Herbert M. Brody, Cherry Hill; George L. Weigle, Cinnaminson, both of N.J.

[73] Assignee: International Telephone & Telegraph Corporation, Nutley, N.J.

[21] Appl. No.: 679,592

[22] Filed: Apr. 23, 1976

[51] Int. Cl.[2] ..... F24F 11/04; F24F 7/06

[52] U.S. Cl. ..... 62/180; 98/1.5; 165/16; 236/49; 417/279

[58] Field of Search ..... 417/279; 165/16, 15; 445/148; 236/13, 49; 98/1.5; 62/180

[56] References Cited

U.S. PATENT DOCUMENTS 2,813,235 11/1957 Clay ..... 236/13 X

OTHER PUBLICATIONS

Control Systems for HVAC, Roger W. Haines, pp. 119 & 120 Van Nostrand Reinhold Co., 1971.

Air Conditioning & Ventilation of Buildings Brian M. Roberts, Pergamon Press, 1975, pp. 217 & 218.

*Primary Examiner*—William E. Wayner

*Attorney, Agent, or Firm*—John T. O'Halloran; Peter C. Van Der Sluys

[57] ABSTRACT

A variable air volume air conditioning system is provided with thermostat controlled variable air volume terminal boxes for controlling the volume of constant temperature conditioned air provided to each space to be conditioned. The conditioned air is delivered through a short pressure recovery duct to a trunk duct by a centrifugal fan having forward curved blades. The trunk duct pressure is maintained substantially constant by control vanes disposed at the recovery duct outlet, said control vanes being responsive to an increase in duct pressure to close the duct outlet and unload the fan, thereby reducing the energy consumed by the fan. Economizer operation is provided by the use of return air dampers and outside air dampers controlled in response to outside air temperature and air supply duct temperature to mix outside air and return air to reduce the amount of mechanical refrigeration required. A power air return means is provided for returning air to the system from the spaces that are conditioned and for controlling the amount of return air in accordance with the volume of air delivered to the conditioned spaces.

9 Claims, 3 Drawing Figures

46a
46b
44a
44b
56
54
E
38
P
36
33
P
T
40
42
50
34
52
48b
26
60
29
30
32
58
48a
28
20
16
10
12
24
T
SPACE
22
14
18
24
T
SPACE
22
16

50
52
68
66
64
20
62
10
36
18

VARIABLE AIR VOLUME AIR CONDITIONING SYSTEM

BACKGROUND OF THE INVENTION

1. Field of the Invention

The present invention relates to air conditioning systems and, more particularly, to a variable air volume air conditioning system.

2. Description of the Prior Art

Heretofore, most commercially acceptable air conditioning systems have been of the multi-zone variety wherein a fixed volume of air was delivered to the conditioned zone and the temperature of the delivered air was varied depending upon the load requirements of the zones. While the multi-zone type of system provided excellent temperature control, it proved to be very inefficient since it mixed heated air and cooled air to attain the desired temperature. The system also delivered a fixed volume of air so that the power required for delivering the air was also fixed. Thus, the multi-zone type of system proved to be inefficient and uneconomical, especially with the current high cost of energy.

Variable air volume systems provide conditioned air at a fixed temperature and merely vary the amount of air delivered to the space in accordance with the cooling requirements of the space. Thus, the variable air volume systems result in a savings in fan horsepower and also in mechanical cooling since only the amount of air required for cooling is actually cooled and delivered. Significant technical problems have been encountered with variable air volume systems since as the cooling load diminishes, the dampers to the spaces being cooled close and result in a substantial increase in duct pressure. The pressure increase results in increased air velocity, which causes obnoxious noise and can damage the over-pressured air ducts and controls. Thus, a means for relieving the duct over-pressure in the variable air volume systems was required.

One solution to the over-pressure problem in variable air volume systems was to provide a bypass duct for shunting the excess air back to the input of the system. This solution did not provide for any savings in fan horsepower since the same volume of air was handled by the blowers; therefore, one of the advantages of a variable air volume system could not be realized. Another solution to the over-pressure problem was to use dampers at the outlet of the air conditioning unit to reduce the volume of air supplied to the distribution ducts and thereby controlling the duct pressure. The problem encountered in this type of installation was that the entire air conditioning unit was under a very substantial pressure that was detrimental to the air conditioning unit itself, and also substantial pressure drops were experienced across the outlet dampers.

Another solution to the over-pressure problem has been to use an oversized fan having backward-inclined blades with inlet vanes that restrict the inlet open and give the entering air a pre-rotation that reduces the blower capacity depending upon the position of the inlet vanes. This type of installation has been successful in central systems but due to the use of the backward-inclined type of oversized blower, is too expensive for rooftop installations. The backward-inclined type of blade gives good performance where high pressure low velocity type installations are required, such as in high-rise buildings where long duct lengths are standard.

The lack of general acceptance of the prior art variable air volume devices is in part due to the fact that they are not readily adaptable to an economizer-type mode of operation. Thus, the savings in mechanical refrigeration costs associated with economizer operation could not be realized.

Another interesting problem associated with prior art variable air volume systems is that the pressure exerted on the conditioned space would vary depending upon the volume of air delivered thereto. When a large volume of conditioned air was delivered to the space, the pressure within the space would increase and as a result, doors would not close properly since the air pressure would hold the door in a partially open position. At low air delivery volumes, the pressure in the room would be reduced so that difficulty was experienced in drawing the return air back to the conditioning unit. This would be especially true during an economizer mode of operation where much of the room air had to be exhausted. Attempts were made to provide an exhaust fan for removing the room air to compensate for the fresh air being supplied to the room; however, the difference in volume of air being exhausted from the room and that being supplied to the room during different cooling loads would again cause pressure variations in the room. When more air was exhausted than was supplied, a vacuum developed which made it difficult to open doors and also created down-drafts in chimneys which drew flue gas into the building.

SUMMARY OF THE INVENTION

The present invention contemplates a variable air volume air conditioning system wherein the supply air is maintained at a constant temperature, and the volume of air provided to a space is controlled in accordance with the cooling requirements of the space as determined by a space thermostat. The space thermostat controls a simple damper for varying the volume of air provided to the space. Supply duct pressure is maintained constant by the use of a fan having forward curved blades in conjunction with a pressure recovery duct, the outlet of which is controlled by opposed outlet control vanes that are responsive to supply duct pressure for controlling the volume of air delivered by the fan. By using the forward curved blades on the fan in conjunction with the outlet control vanes, the fan may easily be unloaded to reduce energy consumption when only a small volume of conditioned air is required. The pressure recovery duct disposed between the fan and the outlet control vanes substantially offsets any pressure drop across the outlet control vanes.

In an embodiment where the variable air volume air conditioning system is controlling only one large space, the outlet control vanes may be controlled directly by the space thermostat rather than indirectly through the duct pressure.

The variable air volume system saves energy in two ways. Firstly, the power required for operating the air handling fan is reduced by unloading the fan when only small volumes of conditioned air are required. Secondly, reducing the volume of air passing through the evaporator substantially reduces the mechanical refrigeration load and only the cooling required by the spaces is provided. The inefficiencies experienced with multi-zone units where heated and mechanically cooled air are mixed to achieve the desired temperature are eliminated in a variable air volume system.

A dual set point temperature controller is provided in the air supply duct for controlling the refrigeration system to maintain the supply air temperature at 55° F during normal operation. However, during the periods when the cooling load is minimal and only a small volume of 55° F air is required, it is possible that certain spaces may be uncomfortably cold due to the 55° F air being supplied thereto. The invention overcomes this difficulty by changing the set point of the temperature controller to 65° F when the outlet vanes close to a position corresponding to approximately 40% of maximum open position. Thus, a supply of slightly warmer air is provided and eliminates the need for supplemental heat or a reheat system.

The present invention is designed to provide an economizer mode of operation where outside air is used for cooling whenever the outside air has the proper temperature and humidity. When the outside air temperature is 55° F or below, the mechanical refrigeration is shut down, and outside air in combination with return air is used to provide the space cooling. A pair of dampers are used to properly mix the outside and return air to achieve the desired supply air temperature in response to the temperature controller in the supply air duct. During periods when the outdoor air temperature is between 55° F and 70° F, it is more economical to cool the outside air using mechanical refrigeration than to cool the warmer return air. During this period, the outside air damper is 100 percent open, and the compressor is operated at various stages of unloading so that the desired air supply temperature is achieved. An enthalpy sensor is provided to sense the enthalpy of the outside air and whenever the enthalpy rises above a particular set point, the enthalpy sensor overrides the temperature control and closes the outside air dampers to the minimum outside air ventilation position.

Due to the varying volume of air provided to the conditioned space, pressure variations within the space are experienced. Particularly during the economizer mode of operation, it is required that means be provided for either returning room air to the conditioning unit or for exhausting room air. The present invention contemplates two embodiments of power return systems. A two-speed exhaust fan may be provided to remove air from the building to prevent pressure build-up within the conditioned space. Since the volume of air provided to the space varies, the exhaust fan is provided with a two-speed operation so that at a predetermined position of outlet vane opening the fan will switch from low speed to high speed operation so as to partially compensate for the variation in air volume being delivered to the conditioned space.

In a more sophisticated embodiment, a centrifugal return air fan, having forward curved blades similar to the supply air fan, and a set of outlet control vanes is provided for drawing air from the conditioned space and delivering said air to the conditioning unit. The outlet vanes of the return air fan are controlled in a corresponding relation to the outlet vanes of the supply air fan. A set of pressure release exhaust air dampers are disposed downstream of the returned air fan to provide for the discharge of return air when the return air dampers are closed down and outside air is being used by the system.

The primary objective of the present invention is to provide an air conditioning system that operates with greater efficiency than heretofore provided.

Another objective of the present invention is to provide a variable air volume air conditioning system wherein the fan power consumption may be reduced in corresponding relation to the volume of air delivered.

Another objective of the present invention is to use outlet vane controls in conjunction with a fan having forward curved blades and a pressure recovery duct so that pressure drops are compensated for across the outlet vanes of the fan.

Another objective of the present invention is to reduce the mechanical refrigeration requirements of an air conditioning system by varying the volume of air flowing through the evaporator in accordance with the cooling requirements of the space to be conditioned.

Another objective of the present invention is to provide a variable air volume air conditioning system that is adaptable to an economizer mode of operation.

Another objective of the present invention is to provide a power air return means for drawing a controlled volume of air from the conditioned space, thereby preventing excessive pressure variations within the conditioned space.

Other objectives and advantages of the present invention will become apparent from reading of the following description of the invention, taken in conjunction with the drawings, which describes two embodiments of the present invention.

DESCRIPTION OF THE INVENTION

Figure 1:
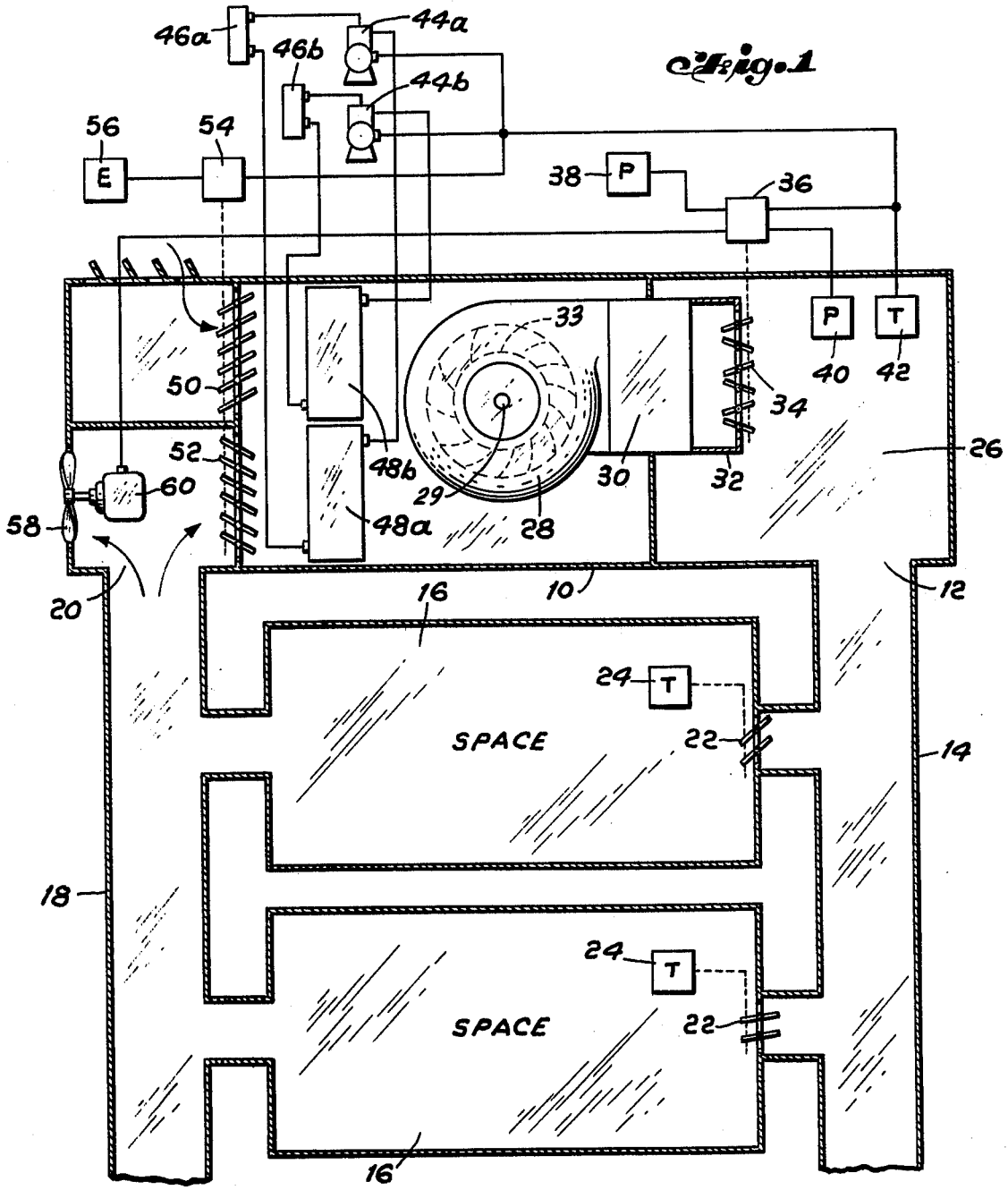
FIG. 1 is a schematic representation of the variable air volume air conditioning system of the present invention.

Referring to FIG. 1, there is shown a schematic representation of the present invention showing the air conditioning unit 10 having an outlet 12 connected to a trunk duct 14 which extends throughout a zone of a building and is connected to a plurality of spaces 16 for providing conditioned air at a predetermined temperature to said spaces. A return air duct 18 is connected to the spaces 16 for returning air to an air inlet 20 of the air conditioning unit 10. The unit 10 is capable of cooling a plurality of spaces by providing conditioned air at a predetermined temperature and pressure to the terminal box for each of the spaces in volumes sufficient to cool each space. The conditioned air at the predetermined temperature is admitted to each space by a variable air volume terminal box 22 controlled by a space thermostat 24. The terminal boxes 22 throttle the flow of conditioned air so that the cooling requirements of each of the spaces are met. The terminal boxes may be inexpensive, simple damper devices controlled by any of the standard type control systems such as electronic, pneumatic, system powered or self-contained controls.

Figure 3:
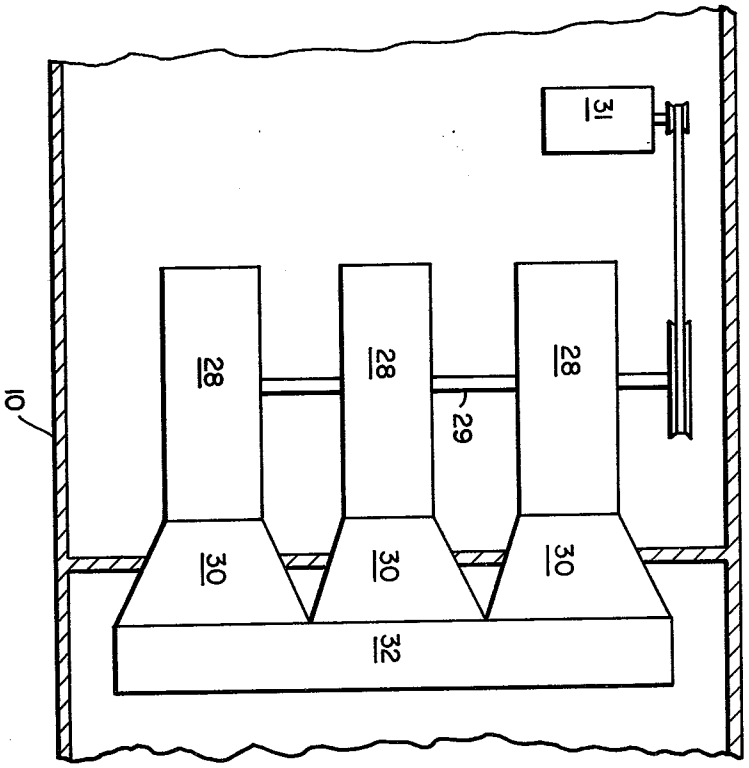
FIG. 3 is a schematic representation of a portion of the system shown in FIG. 1 illustrating the use of a plurality of fans.

As the volume of conditioned air supplied to the spaces is reduced as a result of reduced cooling requirements, the pressure in the trunk duct 14 and a supply duct 26 of unit 10 would substantially increase unless means were provided to maintain a substantially constant duct pressure. Substantially constant duct pressure is achieved through a unique combination of elements that also reduce the energy requirements of the air conditioning unit 10. Unit 10 is provided with one or more supply fans 28, the number of which is determined by the capacity of unit 10. It is most common to provide a unit with two or three such fans on a common drive shaft 29 driven by a single motor 31 as shown in FIG. 3. Fan 28 has a low-cost blower wheel having forward curved blades 33 which, when used in conjunction with the other elements of the present invention, provides very desirable operating characteristics for a variable air volume system. Forward curved blades are useful in that they may be easily unloaded to effect energy saving during partial loading. The forward curved fans may be unloaded by merely blocking the output air flow which results in substantial reductions in fan horsepower when full capacity is not required. The forward curved fans operate at lower fan speeds and are substantially quieter than backward inclined fans.

A pressure recovery duct 30 is disposed at the fan outlet for converting air velocity energy into pressure. The pressure recovery duct is formed with parallel horizontal sides and flared vertical sides which extend from the outlets of the supply fans to a housing 32 for outlet control vanes 34. The outlet control vanes 34 extend horizontally and are mounted in opposed relation to each other for controlling the volume of air delivered by fan 28. When the vanes 34 are closed down to reduce the volume of air supplied to the supply duct 26, the fan 28 with its forward curved blades becomes unloaded and the fan horsepower is substantially reduced, thereby saving considerable energy as compared with constant volume systems. It has also been discovered that through the unique combination of the fan with forward curved blades, the pressure recovery duct and the outlet control vanes, there is substantially no net pressure drop across the outlet control vanes as was experienced with many prior art devices using dampers of the unit outlet.

Vanes 34 are positioned by a vane controller 36 which may include a drive motor as for example a Honeywell M644 Modutrol Motor and a bidirectional switch used to energize the motor for driving the vanes in either an opening or closing direction. The switch has an adjustable dead band to prevent hunting and oscillation of the controller 36. The bidirectional switch receives an internal building pressure signal from a pressure sensor 38 disposed in the building but not in one of the conditioned spaces. Sensor 38 may be disposed in the air space that is usually found above the ceiling tiles. The bidirectional switch also receives a duct pressure signal from a pressure sensor 40 which may be disposed in the supply duct 26. In large installations, it may be desirable to sense duct pressure in several different positions along the trunk duct 14; therefore, it is contemplated that a plurality of sensors may be used in place of sensor 40 and that the average signal from the plurality of sensors may be provided to the bidirectional switch. The switch is responsive to a change in the difference between the received pressure signals and causes the controller to open or close the vanes. An example of a pressure sensitive bidirectional switch that may be used as part of controller 36 is the Honeywell P246A Static Pressure Regulator. In certain applications, it may also be desirable to make controller 36 responsive to the highest or lowest pressure sensed in the system. Thus, it is contemplated that the pressure sensor 40 may be mounted, during unit installation, in a position that best suits the requirements of the particular installation.

In an alternate embodiment where the unit 10 supplies conditioned air to a single large space, it is contemplated that controller 36 may be controlled directly by the space thermostat, rather than indirectly through a pressure sensor and in such a case terminal boxes 22 would not be required. In this embodiment, the motor of controller 36 could be controlled directly by electrical signals from a space thermostat such as a Honeywell T921 proportional control thermostat or indirectly through a pressure actuated switch controlled by a standard pneumatic thermostat.

Since the variable air volume system varies the volume of air flowing over the evaporator and thereby changes the refrigeration load, means must be provided for controlling the refrigeration system so that a predetermined air temperature is maintained in the supply duct 26. A dual set point temperature controller 42 senses supply duct air temperature and provides signals for maintaining a first temperature set point which may be 55° F. Supply duct air temperature may be controlled by mechanical refrigeration or by the use of outside air in an economizer mode of operation. If the supply duct air temperature drops below the set point and mechanical refrigeration is being used, the controller 42 provides a signal to refrigeration compressors **44*a* and 44*b* for causing the compressors to become unloaded in stages, thereby reducing the refrigeration capacity of the system. If the supply duct air temperature increases above the set point, controller 42** provides a signal to the compressors to add on a stage of refrigeration.

Figure 2:
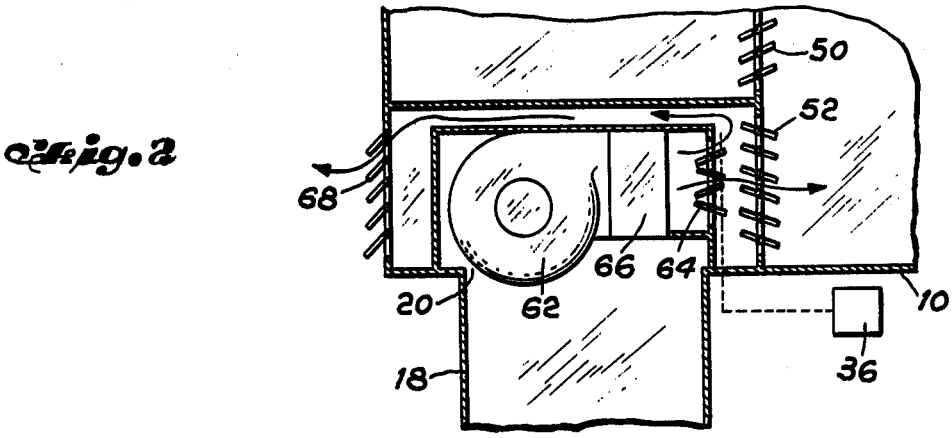
FIG. 2 is a schematic representation of an alternate embodiment of a portion of the system of FIG. 1.

There are several embodiments of known dual set point controllers that may be selected by one skilled in the art to achieve the desired result. One example of such a dual set point controller is shown in FIG. 2 of the commonly assigned United States patent application, Ser. No. 659,398 filed Feb. 19, 1976. Another example of a dual set point controller would use a Honeywell T921E Proportional Control Thermostat having a switch controlled heater to achieve the dual set point feature. Finally, Honeywell R7501 Electronic Proportional Controller, operating in the Direct-Direct Mode could be used in conjunction with a Honeywell C7031J Electronic Temperature Sensor and a pair of Honeywell 14002385-001 Remote Set Point Selectors.

Unit 10 is provided with a dual refrigeration system that operates in parallel, each system comprising compressors **44*a* and 44*b* having outlets connected to condensers 46*a* and 46*b*, the outlets of which are connected to evaporators 48*a* and 48*b*. Evaporators 48*a* and 48*b* are disposed within the air supply path to the supply fan 28. It is contemplated that one of the compressors 44 will be a three-stage six-cylinder compressor and the other a two-stage four-cylinder compressor so that a total of five stages of refrigeration capacity are available. During low refrigeration loads when the last two cylinders are in operation, refrigerant gas may be supplied to the evaporator to balance the load with the compressor capacity prior to the total shutdown of the refrigeration system. Thus, the temperature controller 42 functions to load and unload compressors 44*a* and 44*b*** as the mechanical refrigeration demand of the system varies.

As the refrigeration load of the spaces being cooled is reduced, the outlet control vanes 34 will close down and supply a smaller volume of cool air at 55° F to the duct 14. At this point in the operation of the system, it is possible that certain spaces may be uncomfortably cold and could require heat from an auxiliary heating source. To alleviate this problem and the potential waste of auxiliary heat, controller 36 provides a signal to the dual set point temperature controller 42 when the vanes are shut down to a predetermined percentage of maximum opening, such as 40 percent, so that controller 42 is reset to a second set point such as 65° F rather than 55° F. Said signal may be a switched output from the Modutrol Motor or a signal provided by the switched output. The 65° F conditioned air should provide sufficient ventilation and comfortable conditions for the occupants of all the spaces that are being conditioned. Raising the supply duct temperature set point to 65° F also allows for a greater use of an economizer mode of operation where outdoor air is used for cooling.

Economizer operating capability is provided by the use of interconnected outside air dampers 50 and return air dampers 52 for controlling the ratio of outside air to return air that is allowed to pass through the evaporators 48*a* and 48*b* into the cooling unit 10. The dampers are arranged so that as the outdoor air dampers 50 open, the return air dampers 52 close. The dampers are controlled by a controller 54 which is responsive to a signal from the temperature controller 42 for adjusting the relative amounts of outside and return air supplied to the system to maintain the supply duct air temperature at the set point. Controller 54 is also responsive to an outdoor air enthalpy sensor 56, as for example the Honeywell H205A Enthalpy Control, which overrides the signal from the temperature controller 42 when the outside air enthalpy rises above a predetermined cutoff level and causes the controller 54 to drive the outside air dampers 50 to a position that provides only a minimum amount of outside air for ventilation purposes. Thus, by using an outdoor enthalpy sensor to control the economizer operation, the maximum operating economy may be realized by assuring the maximum use of outdoor air to reduce the mechanical refrigeration load.

Concerning the operation of the system, it is to be understood that whenever the outside air enthalpy is below the set point of the enthalpy sensor 56, the system will attempt to use outdoor air for cooling purposes and the position of the outdoor air dampers and return air dampers 50 and 52 will be controlled by the temperature controller 42 so that the proper mixture is provided to achieve the desired air temperature set point in the supply air duct. When the cooling load increases to a point where 100% outside air does not satisfy the supply duct temperature controller set point, the controller causes the first stage of mechanical refrigeration to be activated by loading two cylinders of the three-stage compressor 44 so that the incoming outside air is cooled as it passes through the evaporator and the temperature set point is satisfied. As the cooling load further increases, additional stages of mechanical refrigeration are provided. When the outside air increases in temperature or humidity so that the enthalpy rises above the enthalpy set point, the outside air dampers are immediately closed down to the minimum ventilation position and mechanical refrigeration is used to cool the return air being supplied through dampers 52.

Since the volume of air being supplied to each space in the building is varied in accordance with the cooling load of the space, the air pressure within the space may vary considerably. A power air return may be applied to draw the air from the spaces back to the air conditioning unit 10 or to exhaust the stale air from the building. An exhaust fan 58 is provided in the return air duct 18 and is driven by a variable or two-speed motor 60. The exhaust fan 58 provides for the removal of air from the building so that a pressure build-up is not experienced in the various spaces. As the variable air volume terminal boxes reduce the air supplied to the various spaces, the exhaust fan will tend to create a reduced pressure in the spaces which could lead to several undesirable results. Therefore, fan motor 60 is controlled by a signal from controller 36 so that when the output control vanes 34 close down to a predetermined percentage of maximum opening, the motor speed is reduced so that less air is drawn out of the spaces and a reasonably constant pressure is maintained in the spaces.

Returning to FIG. 2, there is shown a more sophisticated embodiment of a power return system wherein a centrifugal return air fan 62, similar to the supply fan 28, is used for drawing the room air back to the air conditioning unit 10. Preferably, fan 62 has forward curved blades and also has outlet control vanes 64 identical to vanes 34 associated with fan 28. Disposed between fan 62 and outlet control vanes 64 is a pressure recovery duct 66 similar to duct 30 associated with fan 28. The outlet control vanes 64 are mechanically connected to controller 36 so that they are positioned in corresponding relationship to the position of vanes 34 associated with the supply fan 28, thereby balancing the supply and return air. Thus, during low cooling load requirements when only small volumes of conditioned air are required, the outlet vanes 64 will be almost closed and fan 62 unloaded, thereby reducing the energy consumed by the fan motor in a manner identical to that of fan 28.

Downstream from fan 62, there are provided pressure relief exhaust air dampers 68 which may be gravity controlled so that they remain closed until a pressure build-up is experienced downstream of the fan 62 as a result of closure of return air dampers 52, at which time the dampers 68 will open and allow return air to be exhausted.

Thus, the present invention provides a variable air volume air conditioning system wherein there is a substantial reduction in the horsepower consumption of the supply and return air fans during periods of partial load. The horsepower reduction is realized through the use of low-cost forward curved blades on the supply air fan so that the fan may be easily unloaded by closure of the outlet control vanes disposed downstream of a pressure recovery duct. This energy savings is realized without any significant pressure drop across the outlet control vanes. Mechanical refrigeration loads are reduced by supplying only enough conditioned air at a predetermined temperature to satisfy the cooling requirements of the room rather than by mixing heated and mechanically cooled air to achieve a desired temperature. The system is adapted for use in an economizer mode of operation and the use of an enthalpy sensor provides additional energy savings by making maximum use of outdoor air. A power air return system is provided so that during low air volume operation, the air within the conditioned space may be returned to the system for either rejection or return to the cooling unit. Control means are provided for the power air return system so that the pressure levels within the spaces being conditioned are maintained with an acceptable range.

While the invention has been described in connection with a specific apparatus, it is to be understood that the description is made only by way of example and not as a limitation on the scope of the invention as set forth in the objectives and advantages thereof and in the accompanying claims.

What is claimed is:

1. A variable air volume air conditioning system, comprising:

means for providing air at a predetermined temperature;

a forward curved fan for delivering said air, said fan having an inlet for receiving the air from the last mentioned means and an outlet;

a pressure recovery duct having one end connected to the outlet of said fan;

outlet control vane means disposed at a second end of said pressure recovery duct for controlling the volume of air flow from said fan in response to air pressure downstream from the outlet control vane means;

duct means for directing the air from the outlet control vane means to a space to be conditioned; and air volume control means for controlling the volume of air supplied to a space to be conditioned in accordance with the cooling requirements of said space, whereby the air pressure in the duct means is maintained substantially constant by the outlet control vane means.

2. A system as described in claim 1, additionally comprising refrigeration means for cooling said air.

3. A system as described in claim 2, additionally comprising means for controlling the air temperature to a predetermined set point.

4. A system as described in claim 1, having a plurality of forward curved fans having outlets connected to the pressure recovery duct.

5. A system as described in claim 4, wherein said fans are connected to a common drive shaft.

6. A system as described in claim 1, wherein the outlet control vane means comprises a plurality of oppositely disposed outlet vanes for controlling the volume of air delivered by the fan.

7. A system as described in claim 3, wherein the outlet control vane means includes an output for providing a signal corresponding to the position of the outlet control vane means and the means for controlling the air temperature comprises a dual set point temperature controller, the system additionally comprising means connecting the output of the outlet control vane means to the means for controlling air temperature, said means for controlling air temperature being responsive to the signal received from the outlet control vane means for changing the temperature set point, whereby the temperature set point of the means for controlling the air temperature is changed in response to the volume of air flow from the fan.

8. A variable air volume air conditioning system, comprising:

means for providing air at a predetermined temperature;

a forward curved fan having an inlet for receiving said air and an outlet for delivering said air;

a pressure recovery duct having an inlet connected to the outlet of said fan;

outlet control vane means connected to an outlet of the pressure recovery duct for controlling the volume of air delivered by said fan in response to the cooling requirements of a space to be conditioned; and duct means for directing the air to the space to be conditioned.

9. A variable air volume air conditioning system as described in claim 8, additionally comprising:

means associated with the outlet control vane means for providing a signal corresponding to the position of the outlet control means; and means for controlling the first mentioned means in response to the signal from the outlet control vane means to maintain a first predetermined air temperature when a first volume of air or more is delivered to said space and to maintain a second predetermined air temperature when less than the first volume of air is delivered to said space.

* * * * *